US010549883B2

(12) United States Patent
Gonzalez Sanchez

(10) Patent No.: US 10,549,883 B2
(45) Date of Patent: Feb. 4, 2020

(54) PROTECTIVE LID FOR CONTAINERS

(71) Applicant: Jose Francisco Gonzalez Sanchez, Barcelona (ES)

(72) Inventor: Jose Francisco Gonzalez Sanchez, Barcelona (ES)

( * ) Notice: Subject to any disclaimer, the term of this patent is extended or adjusted under 35 U.S.C. 154(b) by 186 days.

(21) Appl. No.: 15/544,086

(22) PCT Filed: Oct. 27, 2015

(86) PCT No.: PCT/ES2015/070775
§ 371 (c)(1),
(2) Date: Jul. 17, 2017

(87) PCT Pub. No.: WO2016/113441
PCT Pub. Date: Jul. 21, 2016

(65) Prior Publication Data

US 2017/0361979 A1 Dec. 21, 2017

(30) Foreign Application Priority Data

Jan. 15, 2015 (ES) ..... 201530041

(51) Int. Cl.
*B65D 41/62* (2006.01)
*B65D 17/28* (2006.01)
*B65D 43/16* (2006.01)

(52) U.S. Cl.
CPC ..... *B65D 17/4014* (2018.01); *B65D 17/4012* (2018.01); *B65D 43/163* (2013.01); *B65D 2517/0041* (2013.01)

(58) Field of Classification Search
CPC ..... B65D 17/4014; B65D 17/4012; B65D 43/163; B65D 2517/0041; B65D 2517/0098
(Continued)

(56) References Cited

U.S. PATENT DOCUMENTS

| | | | |
|---|---|---|---|
| 5,273,176 | A | 12/1993 | Diaz |
| 2007/0295737 | A1 | 12/2007 | Del Val Catala |
| 2016/0137365 | A1 | 5/2016 | Gonzalez Sanchez |

FOREIGN PATENT DOCUMENTS

| | | |
|---|---|---|
| DE | 29511285 | 10/1995 |
| DE | 19927779 | 12/2000 |

(Continued)

OTHER PUBLICATIONS

International Search Report for PCT/ES2015/070775, English Translation attached to original, Both completed by the European Patent Office dated Feb. 25, 2016, 7 pages.

*Primary Examiner* — Andrew T Kirsch
*Assistant Examiner* — Elizabeth J Volz
(74) *Attorney, Agent, or Firm* — Brooks Kushman P.C.

(57) ABSTRACT

A protective lid for containers, having an upper lid provided for covering the upper part of the container, and a hinge section provided for exerting an angular movement of the upper lid in relation to the upper face of the container, the hinge section having at least one connecting portion with a contact surface provided for being adhered by an adhesive material to the lateral wall of the container. The contact surface has an arched trajectory with a radius that is substantially equal to the bend radius of the lateral wall of the container, and with a length that is less than the circumferential length of the lateral wall of the container. In this way, the protective lid is not provided with a lower ring for securing same to the container, thereby simplifying the production and assembly process.

10 Claims, 10 Drawing Sheets

(58) Field of Classification Search
USPC ..... 220/836, 694, 258.2, 276, 375, 718; 215/232, 235
See application file for complete search history.

(56) References Cited

FOREIGN PATENT DOCUMENTS

| | | | | |
|---|---|---|---|---|
| DE | 20209535 | | 10/2003 | |
| ES | 1052705 | | 2/2003 | |
| ES | 1072101 | | 5/2010 | |
| FR | 2898110 | * | 9/2007 | ..... B65D 51/20 |
| WO | 2004110891 | | 12/2004 | |
| WO | 2006098611 | | 9/2006 | |
| WO | 2015001153 | | 1/2015 | |
| WO | WO2015001153 | * | 1/2015 | ..... B65D 43/16 |

* cited by examiner

PROTECTIVE LID FOR CONTAINERS

CROSS-REFERENCE TO RELATED APPLICATION

This application is the U.S. national phase of PCT Application No. PCT/ES2015/070775 filed on Oct. 27, 2015, which claims priority to ES Patent Application No. P201530041 filed on Jan. 15, 2015, the disclosures of which are incorporated in their entirety by reference herein.

OBJECT OF THE INVENTION

The object of the present application is to register a protective lid for containers that incorporates notable innovations and advantages.

More specifically, the invention proposes the development of a protective lid for containers comprising an upper lid provided for covering the upper part of the container and a hinge section that simplifies the assembly and reduces the number of components.

BACKGROUND OF THE INVENTION

At present, the existence of protective means for containers is known, for example, provided for the consumption of beverages. The applicant is the holder of various inventions relating to a protection system for containers comprising an upper protective lid and a lower ring, which is diametrically fixed on the upper part of the body of the container, the lid and the lower ring being joined to each other by means of a hinge section.

Although this previously described protective system is effective from a hygienic point of view and ease of use for the user or consumer, the assembly process thereof on the containers is laborious, consequently the placement time for each protector on the corresponding container thereof involves a significant amount of time.

Furthermore, the applicant does not know of any invention at present that is provided with all the characteristics described in this specification.

DESCRIPTION OF THE INVENTION

The present invention has been developed with the aim of providing a protective lid that is configured as a novelty within the field of application and resolves the drawbacks previously mentioned, also providing other additional advantages which will be evident from the description included below.

It is therefore an object of the present invention to provide a protective lid for containers comprising an upper lid provided for covering the upper part of the container and a hinge section provided for executing an angular movement of the upper lid with respect to the upper face of the container and is essentially characterised in that the hinge section comprises at least one hooking portion with a contact surface provided for being adhered by means of an adhesive material on the lateral wall of the container, said contact surface having an arched course with a radius significantly equal to the radius of curvature of the lateral wall of the container and with a length less than the circumferential length of the lateral wall of the container.

It should be mentioned that the adhesive can be applied directly on the contact surface of the hinge section or on the area of the lateral wall of the container where the contact surface is subsequently adhered.

Thanks to these characteristics, the process of placing the protective lid on a container, for example a container in the form of a tin, is facilitated given that it can be joined by the surface with an adhesive on the lateral wall of the container in question, consequently the productivity rates in the process of assembling the protective lids on containers can be increased. Furthermore, when an annular body is not used, the quantity of material required for obtaining the protective lid is reduced and the injection moulding used is simplified, consequently the manufacturing costs are reduced.

Another advantageous aspect, but no less important, is the fact that it can also facilitate and reduce the stacking volume during the storage thereof, for example, prior to assembling the protective lids on the corresponding containers.

According to another aspect of the invention, the contact surface has a plurality of cavities arranged along the length of the contact surface.

In a particularly preferred embodiment, the upper lid and the hinge section are made of a single piece.

Advantageously, the length of the contact surface of the hooking portion is less than one quarter of the circumferential length of the lateral wall of the container.

The hooking portion also preferably has a transversal cross-section in the form of a rectangular trapezoid.

It is another object of the invention to provide a container comprising a body with a noticeably cylindrical form that includes a protective lid like the one described previously.

Advantageously, there is the possibility of the upper lid including positioning means. In a preferred embodiment, such positioning means consist of a plurality of partitions arranged radially projecting from the inner face of the upper lid, on which said partitions can fit into a plurality of housings in a complementary manner with respect to the partitions and arranged on the outer face of the upper lid. In this way, the stacking of protective lids on top of each other is facilitated during the manufacturing process and storage thereof, said partitions preventing the protective lid from rotating in an undesired manner and ensuring the stacking.

Additionally, the upper lid has watertight means that ensure the upper lid is sealed with respect to the container. These watertight means may preferably comprise a double lip that projects downwards and circumferentially from the flange of the upper lid.

According to another characteristic of the protective lid of the invention, the hinge section also has clipping means that connect the two articulated halves or portions constituting the hinge section in a closed state of the upper lid, which facilitates manufacturing by means of an injection process of the protective lid assembly in an open state, that is to say, the two articulated halves or portions of the hinge being noticeably axially aligned and, consequently, facilitate the manufacturing process thereof. Thus, it also enables the hinge to be maintained in a static position during the adhesion process of the hinge section to the container.

Also advantageously, the upper lid may include at least one safety seal. In a preferred embodiment, said safety seal is defined by at least one weakened region that has a thinner segment than the rest of the material of the upper lid, which extends from the outer flange of the circumferential contour of the upper lid and laterally with respect to the position of a projecting tab. In this way, the user can be guaranteed that the lid, and consequently, the container, has not been manipulated prior to the consumption thereof. Thus the arrangement of this thinner segment is broken when the user attempts to press on or bend the upper lid in an ascending direction by means of placing a finger in the area of the projecting tab.

Other characteristics and advantages of the protective lid object of the present invention will be evident from the description of a preferred, but not exclusive, embodiment, illustrated by way of non-limiting example in the accompanying drawing, in which:

DESCRIPTION OF A PREFERRED EMBODIMENT

In light of the aforementioned figures and according to the adopted numeration, a preferred exemplary embodiment of the invention may be seen in said figures, which comprises the parts and elements that are indicated and described in detail below.

Thus, as can be seen in the attached figures, the protective lid for containers essentially comprises an upper lid (1) provided for covering the upper part of the container (2) and a hinge section (3) provided for executing an angular movement of the upper lid with respect to the upper face of the container, which has a pair of regions by way of a shaft (30).

Figure 1:
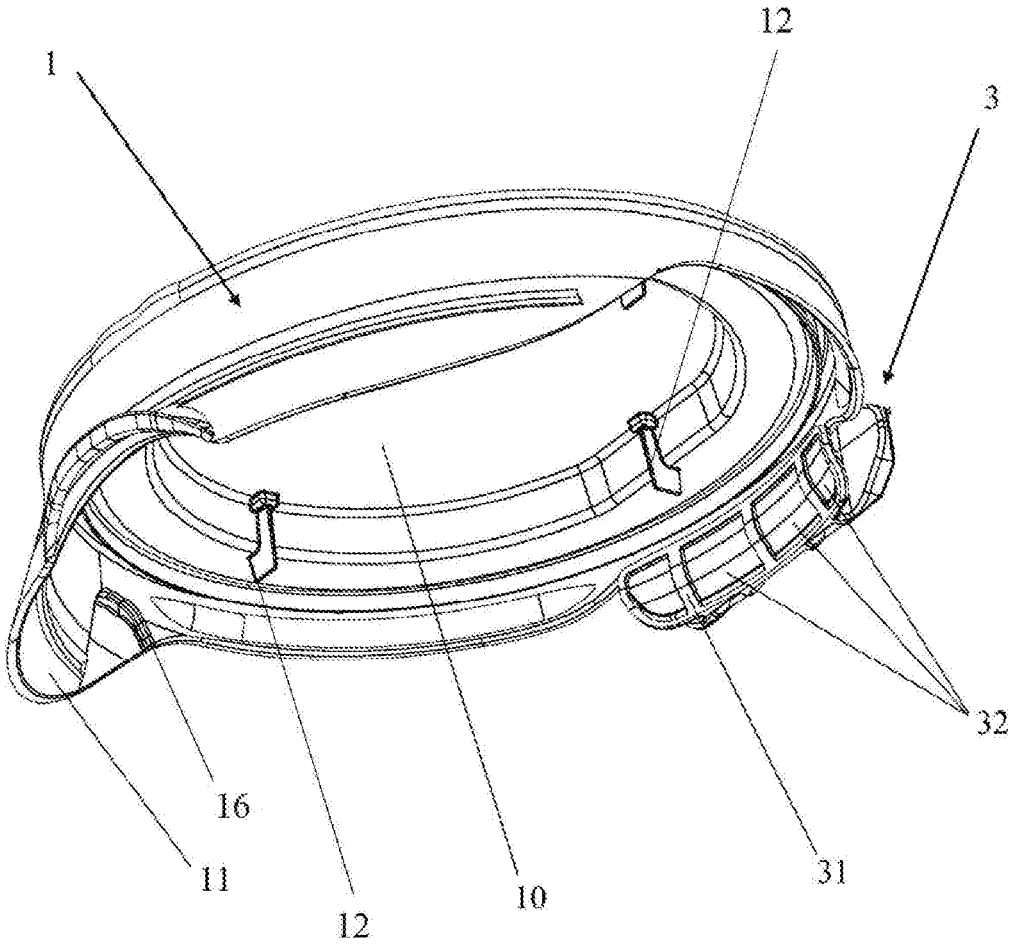
FIG. 1 is a perspective view of an embodiment of the protective lid according to the present invention.
Figure 2:
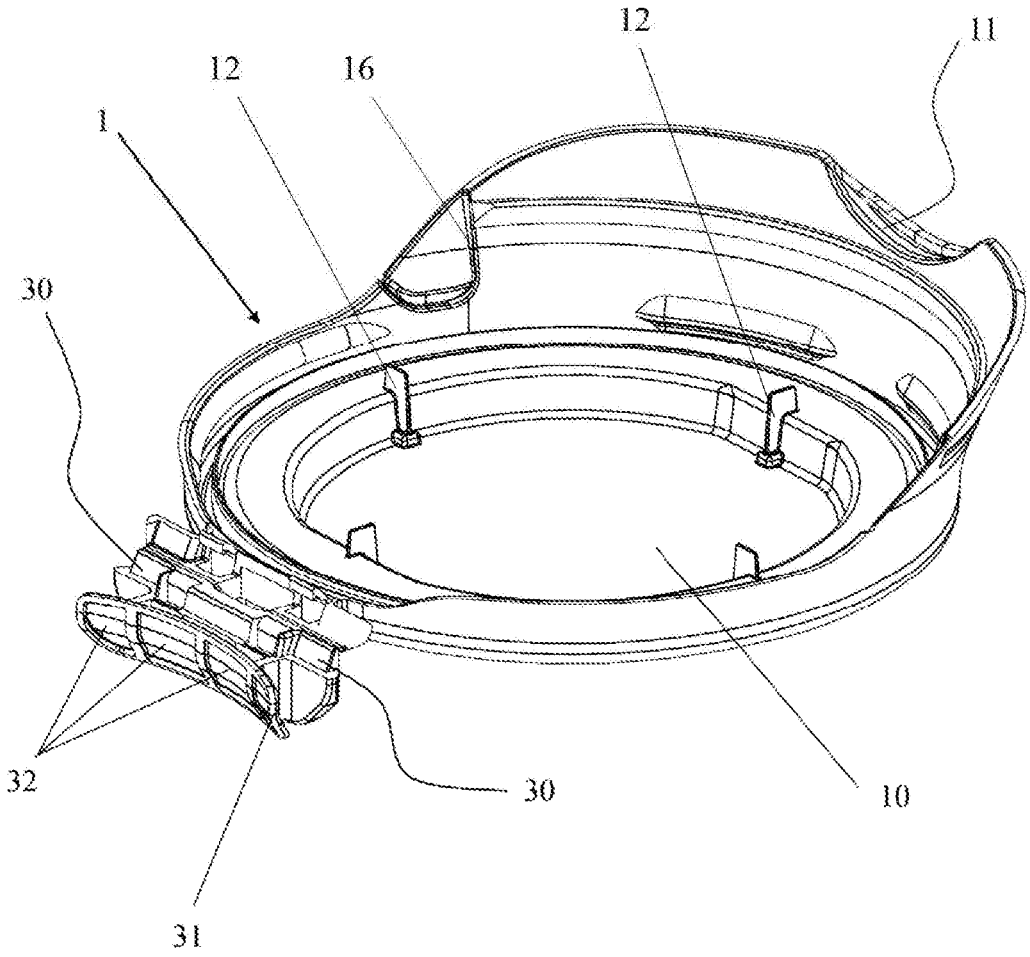
FIG. 2 is a perspective view from another point of view of the protective lid represented in FIG. 1.

As may be seen with greater clarity in FIGS. 1 and 2, the hinge section (3) comprises a hooking portion with a contact surface (31) provided for being adhered by means of an adhesive material on the lateral wall (20) of the container (2), said contact surface (31) having a slightly arched course, the radius thereof being noticeably equal to the radius of curvature of the lateral wall of the container (2), having a length less than the circumferential length of the lateral wall of the container. More preferably, the length of the contact surface of the hooking portion is less than one quarter of the circumferential length of the lateral wall (20) of the container (2).

It should be mentioned that the hooking portion has a transversal cross-section in the form of a rectangular trapezoid in which the contact surface (31) has a plurality of cavities or recesses (32) separated equidistantly from each other and being arranged along the length of the contact surface (31). This rectangular trapezoid shape is suitable for conventional metal tin-type containers that have a low cylindrical section (21) (see FIG. 6) in the upper part of the lateral wall (20) from which a frustoconical shaped portion extends downwards such that the hooking portion is perfectly fixed and adapted to the cylindrical section (21) and the frustoconical shaped portion.

Going into greater detail regarding the upper lid (1), it comprises a body made of injection mouldable plastic material with a circumferential form which has a circumferential flange and a central elevation part (10) with respect to the annular section that enables the stacking of another container on the protective lid (1), consequently it facilitates the storage of containers during the transport thereof and during marketing of the containers in establishments as well as also enabling and facilitating the stacking of the protective lids for the storage, transport and supply in assembly machines for container lids. Additionally, it includes a projecting tab (11) on the front part which facilitates the operation of raising the upper lid (1) when the user wishes to use the container to consume the beverage contained therein.

Figure 3:
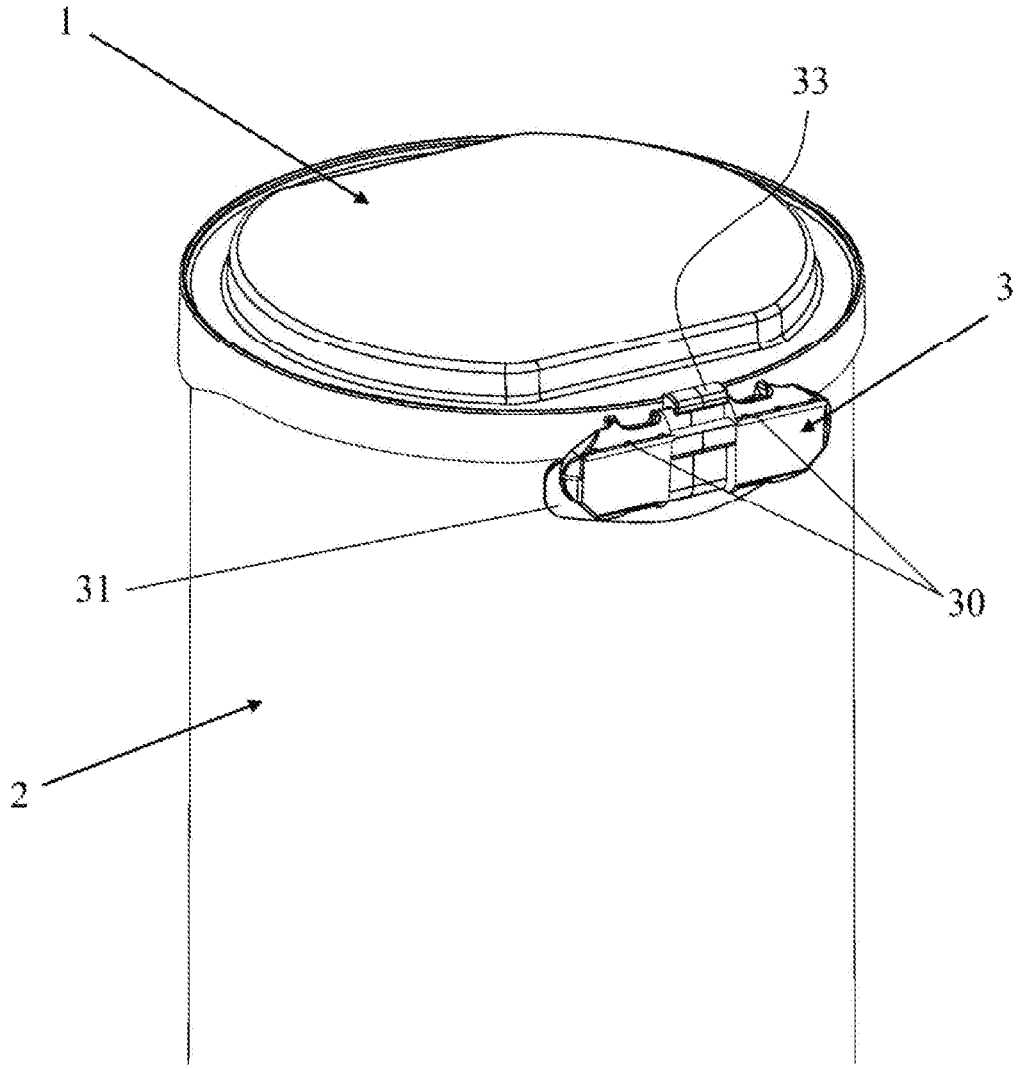
FIG. 3 is a partial perspective view of a container provided with the protective lid according to the present invention.
Figure 4:
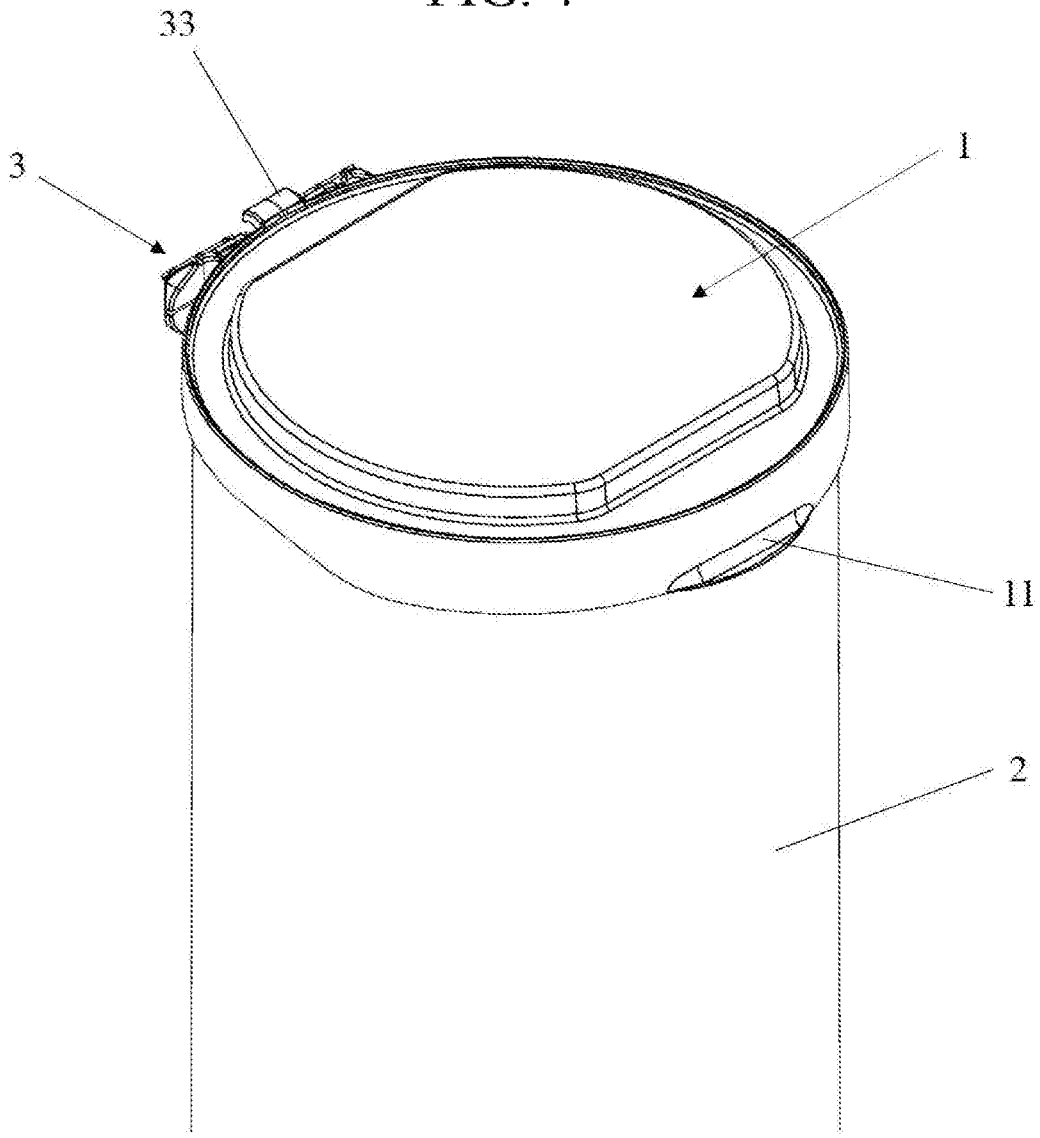
FIG. 4 is a partial perspective view of the container shown in the previous figure from another point of view.
Figure 5A:
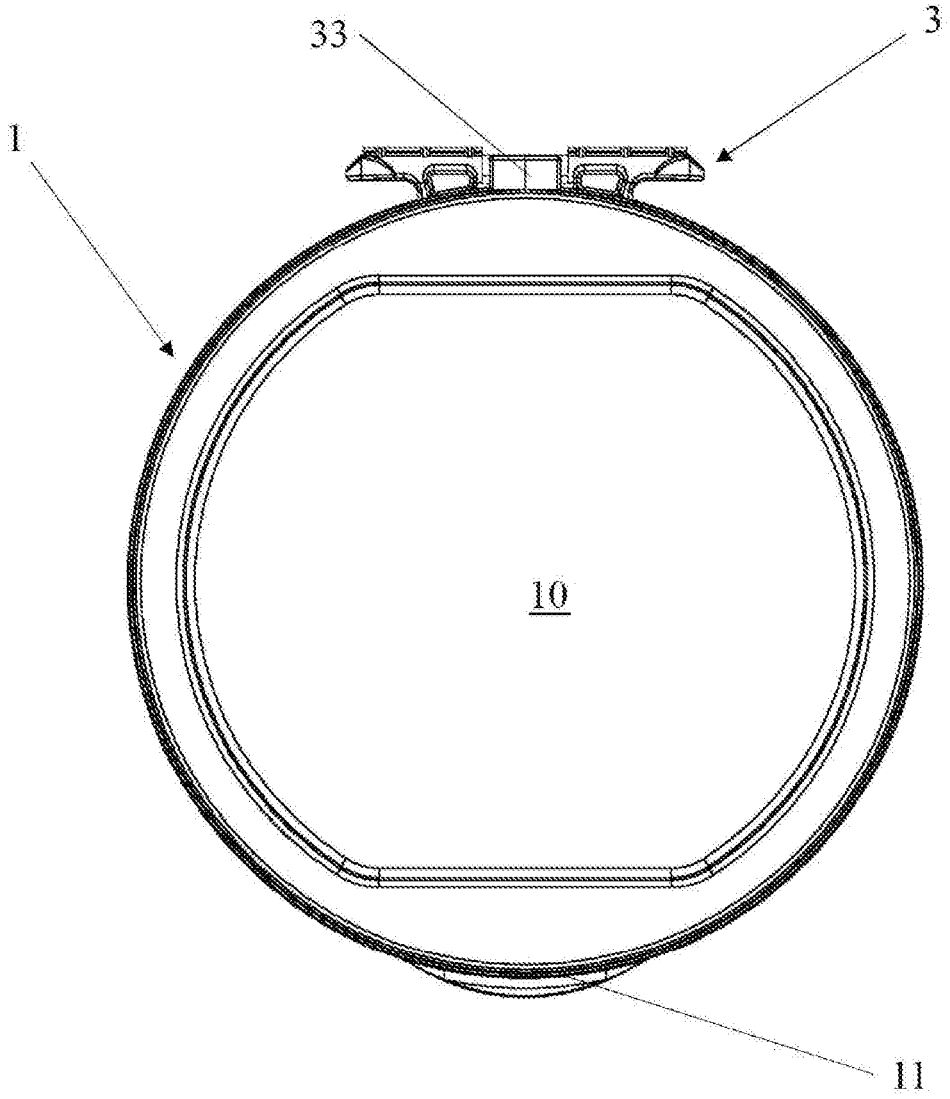
FIGS. 5A and 5B are upper plan views of a container with two embodiments of the protective lid of the invention, in which in FIG. 5A the hinge section is laterally extended while in FIG. 5B the hinge section is shorter in length with respect to FIG. 5A.
Figure 5B:
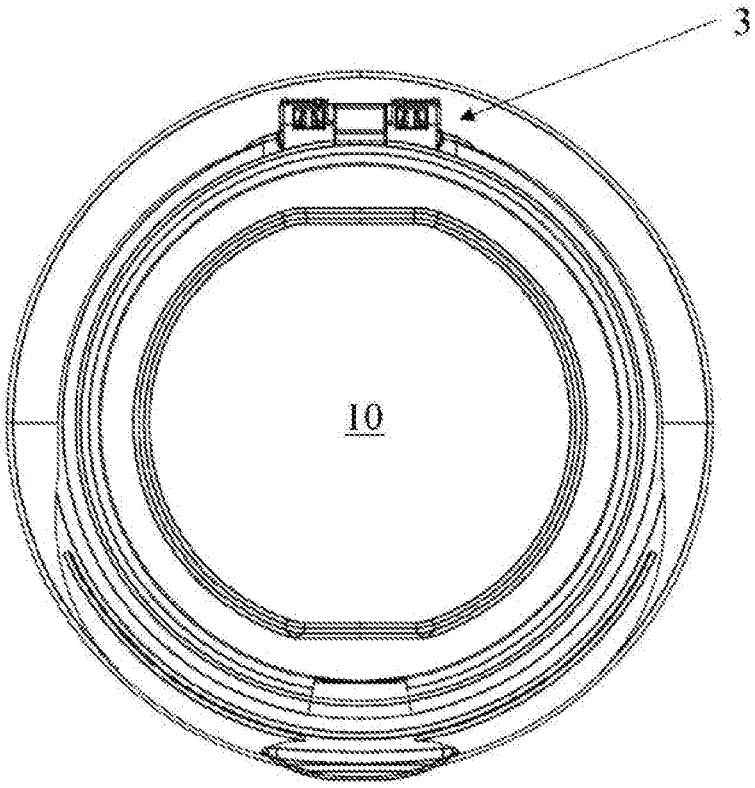
Figure 6:
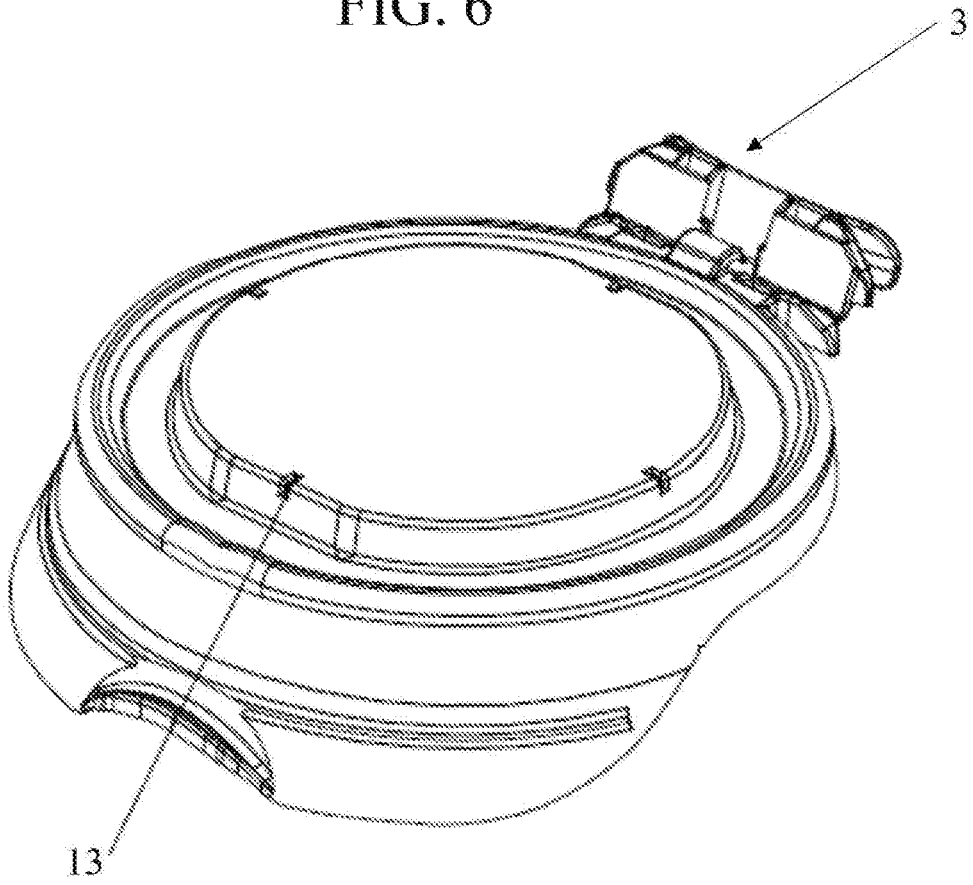
FIG. 6 is an upper perspective view of the protective lid of the invention.
Figure 7:
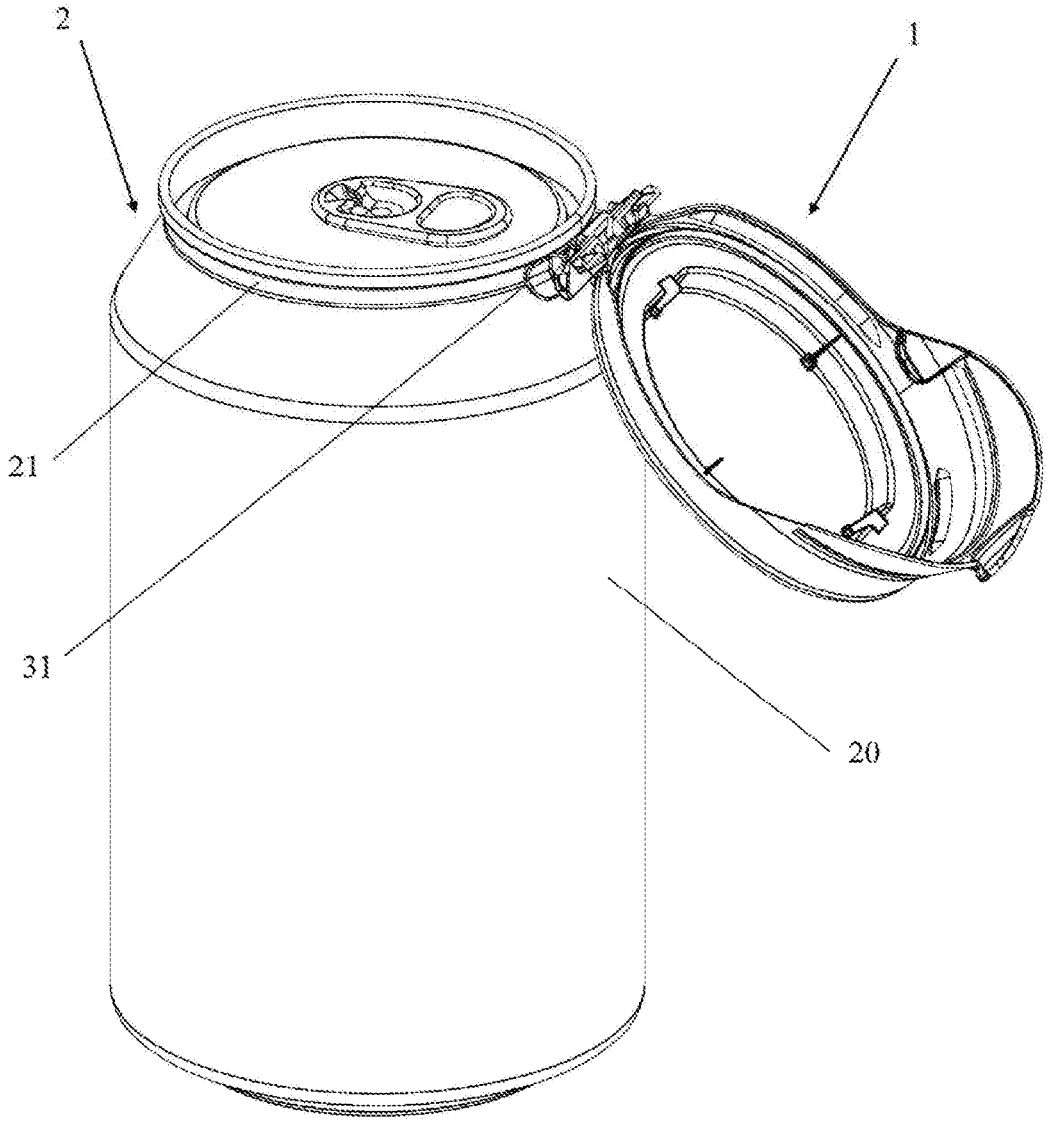
FIG. 7 is a perspective view of the container with the upper lid in an open state.

Returning again to the hinge section (3), it can include an arched projection (33) (see FIGS. 3 to 5) that is used as a locking mechanism for enabling the upper lid (1) to be maintained in a completely open position during the dispensing process of the beverage or liquid present inside the container (2), corresponding to the position represented in FIG. 6.

Both the upper lid (1) and the hinge section (3) can be made of a single piece and of a biodegradable material.

As can be seen in FIGS. 1, 2, 6 and 7, the upper lid (1) includes positioning means for the purpose of an anti-rotation system that consist of a plurality of partitions (12) arranged radially projecting from the inner face of the upper lid (1), said partitions (12) being capable of fitting into a plurality of housings (13) (see FIG. 6) that adopt a complementary shape with respect to the partitions (12) and arranged on the outer face of the upper lid (1).

In order to simply and practically ensure that the protective lid has not been manipulated prior to the opening of the container, the upper lid (1) includes a safety seal that is essentially defined by a pair of weakened regions or break lines, each one of which having a thinner segment (16) than the rest of the material of the upper lid (1) (see FIGS. 1 and 2) that extends from the outer flange of the circumferential contour of the upper lid (1) and laterally with respect to the position of a projecting tab (11).

Making particular reference now to FIGS. 5A and 5B, the upper part of a container with two embodiments of the protective lid of the invention has been represented, in which in FIG. 5A the hinge section extends laterally, such that it facilitates the placement of a grouping of protective lids stacked in a supply channel provided with a longitudinal recess in an assembly line for container lids. Additionally, there is also the possibility, as shown in FIG. 5B, that the hinge section is shorter in length with respect to FIG. 5A.

Figure 8:
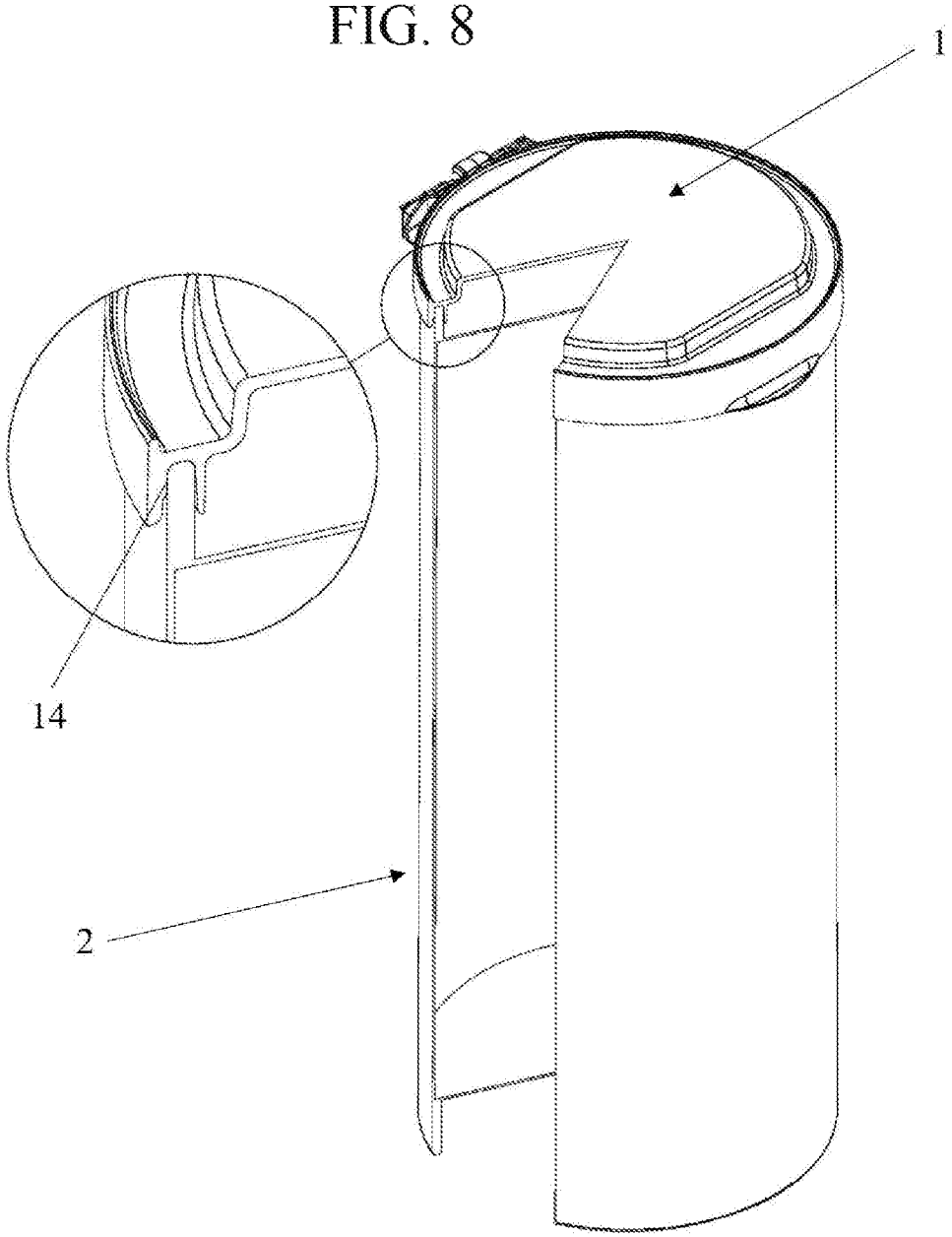
FIG. 8 is a partial cross-sectional perspective view of a container with the protective lid in a closed state, which includes a view with greater detail.

In an embodiment represented in FIG. 8, the upper lid (1) has watertight means comprising a relatively flexible double lip (14) that projects downwards and circumferentially from the flange of the upper lid (1) which can be coupled to the circumferential projecting flange of the container (2) in the form of a tin.

Figure 9:
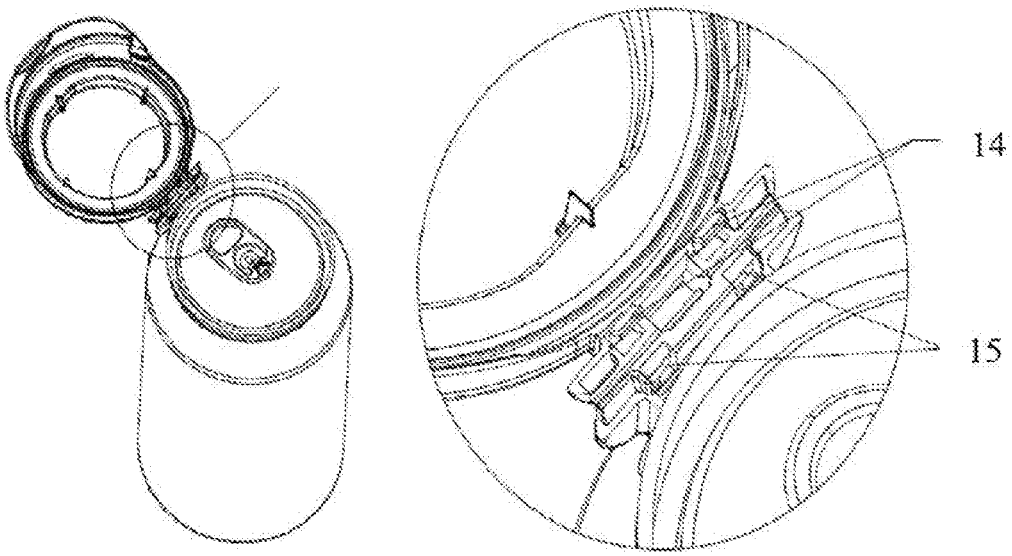
FIG. 9 is a perspective view and a detailed view of the clipping means present on the protective lid.

Furthermore, in order to facilitate the industrialisation process of the protective lid previously described, the hinge section (3) can have clipping means which connect the two halves of the hinge section (3) in a closed state of the upper lid (1). These clipping means essentially consists of a pair of hooks (14) distanced from each other and situated in one of the halves or portions articulated relative to each other that can be inserted when the upper lid (1) is pushed into corresponding cavities (15) present on the other articulated half or portion as is shown in greater detail in FIG. 9.

The details, shapes, dimensions and other accessory elements used in the manufacturing of the protective lid of the invention may be conveniently substituted for others that do not diverge from the scope defined by the claims included below.

The invention claimed is:

1. A protective lid for containers comprising an upper lid provided for covering the upper part of the container and a hinge section provided for executing an angular movement of the upper lid with respect to the upper face of the container, comprising the hinge section at least one hooking portion with a contact surface provided for being adhered by means of an adhesive material on the lateral wall of the container, wherein said contact surface having an arched course with a radius significantly equal to the radius of curvature of the lateral wall of the container and with a length less than the circumferential length of the lateral wall of the container, the contact surface having a plurality of cavities arranged along the length of the aforementioned contact surface, and wherein the upper lid includes a positioning means consisting of a plurality of partitions arranged radially projecting from the inner face of the upper lid, said partitions being capable of fitting into a plurality of housings in a complementary manner with respect to the partitions and arranged on the outer face of the upper lid.

2. The protective lid for containers according to claim 1, wherein the upper lid and the hinge section are made of one single piece.

3. The protective lid for containers according to claim 1, wherein the length of the contact surface of at least one hooking portion is less than one quarter of the circumferential length of the lateral wall of the container.

4. The protective lid for containers according to claim 1, wherein at least one hooking portion has a transversal cross-section in the form of a rectangular trapezoid.

5. The protective lid for containers according to claim 1, wherein the hinge section has clipping means that connect two halves of the hinge section in a closed state of the upper lid.

6. A container comprising:

a body with a significantly cylindrical form, and a protective lid according to claim 1 providing a covering an upper part of the container.

7. A protective lid for containers comprising an upper lid provided for covering the upper part of the container and a hinge section provided for executing an angular movement of the upper lid with respect to the upper face of the container, comprising the hinge section at least one hooking portion with a contact surface provided for being adhered by means of an adhesive material on the lateral wall of the container, wherein said contact surface having an arched course with a radius significantly equal to the radius of curvature of the lateral wall of the container and with a length less than the circumferential length of the lateral wall of the container, the contact surface having a plurality of cavities arranged along the length of the aforementioned contact surface wherein the upper lid has watertight means.

8. The protective lid for containers according to claim 7, wherein the watertight means comprise a double lip that projects downwards and circumferentially from the flange of the upper lid.

9. A protective lid for containers comprising an upper lid provided for covering the upper part of the container and a hinge section provided for executing an angular movement of the upper lid with respect to the upper face of the container, comprising the hinge section at least one hooking portion with a contact surface provided for being adhered by means of an adhesive material on the lateral wall of the container, wherein said contact surface having an arched course with a radius significantly equal to the radius of curvature of the lateral wall of the container and with a length less than the circumferential length of the lateral wall of the container, the contact surface having a plurality of cavities arranged along the length of the aforementioned contact surface, wherein the upper lid includes at least one safety seal.

10. The protective lid for containers according to claim 9, wherein the safety seal is defined by at least one weakened region which has a thinner segment than the rest of the material of the upper lid, extending from the outer flange of the circumferential contour of the upper lid and laterally with respect to the position of a projecting tab.

* * * * *